US011495094B1

(12) United States Patent
Nankov et al.

(10) Patent No.: US 11,495,094 B1
(45) Date of Patent: Nov. 8, 2022

(54) ENTERTAINMENT SYSTEM

(71) Applicants: Ivaylo Nankov, South Yarmouth, MA (US); Ivet Nankova, South Yarmouth, MA (US)

(72) Inventors: Ivaylo Nankov, South Yarmouth, MA (US); Ivet Nankova, South Yarmouth, MA (US)

( * ) Notice: Subject to any disclaimer, the term of this patent is extended or adjusted under 35 U.S.C. 154(b) by 50 days.

(21) Appl. No.: 17/323,478

(22) Filed: May 18, 2021

(51) Int. Cl.
*G07F 17/32* (2006.01)

(52) U.S. Cl.
CPC ..... *G07F 17/3293* (2013.01); *G07F 17/3209* (2013.01); *G07F 17/3211* (2013.01)

(58) Field of Classification Search
None
See application file for complete search history.

(56) References Cited

U.S. PATENT DOCUMENTS

| | | | | |
|---|---|---|---|---|
| 4,746,126 | A | 5/1988 | Angileri | |
| 5,114,153 | A | 5/1992 | Rosenwinkel | |
| 5,417,432 | A | 5/1995 | Dwyer | |
| 6,234,483 | B1 | 5/2001 | Bucan | |
| 6,234,486 | B1 | 5/2001 | Wallice | |
| 6,457,716 | B1 | 10/2002 | Johnson Prillerman | |
| 6,598,880 | B2 | 7/2003 | Addabbo | |
| 6,651,984 | B1 | 11/2003 | Luken | |
| 7,014,191 | B2 | 3/2006 | Nasco | |
| 7,234,701 | B2 | 6/2007 | Hungerford | |
| 10,878,664 | B2 * | 12/2020 | Zyxnfryx | G07F 17/3223 |
| 2010/0096808 | A1 | 4/2010 | Johnson | |
| 2014/0248930 | A1 | 9/2014 | Fishel | |
| 2016/0140808 | A1 * | 5/2016 | Scott | G07F 17/3276 463/11 |
| 2018/0015358 | A1 * | 1/2018 | Mahon | G07F 17/329 |
| 2018/0021667 | A1 * | 1/2018 | Mahon | A63F 3/00157 463/16 |

FOREIGN PATENT DOCUMENTS

| | | |
|---|---|---|
| WO | 2004019303 | 3/2004 |
| WO | 2008088345 | 7/2008 |

* cited by examiner

*Primary Examiner* — Ronald Laneau
(74) *Attorney, Agent, or Firm* — Lambert Shorten & Connaughton; David J. Connaughton, Jr.; Justin P. Tinger

(57) ABSTRACT

An entertainment system is provided. The system provides a unique display and input/output system, and structure. The entertainment system provides optional and unique features including card-based game play. The entertainment system may include networked embodiments to allow for multi-player engagement. Further, computerized players may be programmed to mimic real players thereby allowing for multi-player engagement in offline or solo situations.

20 Claims, 10 Drawing Sheets

ENTERTAINMENT SYSTEM

BACKGROUND OF THE INVENTION

Field of the Invention

The present invention relates generally to a gaming system. More particularly the present invention relates to a game and entertainment machine device providing strategic and advantageous modes of game play.

Description of Related Art

Card games, and their computerized counterparts, are staples at casinos, in homes, at gatherings (virtual and in person) and other gambling establishments, and online. While there are a number of common games, they can become stale and repetitive over time, leading players to seek out new gaming opportunities. The gaming industry is constantly trying to retain the attention of its current customers, and to grab the attention of potential customers. Accordingly, new and exciting gaming opportunities are critical for maintenance and growth of the gaming industry.

Card game services, online, retail, and in casino or other gaming settings, as well as other gaming operators are faced with a number of shortcomings of existing card games. These include tiring of existing games, speed and capacity limitations on games, and the like.

Therefore, what is needed is an entertainment system which may provide a new, exciting and entertaining entertainment experience.

SUMMARY OF THE INVENTION

The subject matter of this application may involve, in some cases, interrelated products, alternative solutions to a particular problem, and/or a plurality of different uses of a single system or article.

In one aspect, an entertainment machine is provided. The entertainment machine has a data processor, display in communication with the processor, and user interface in communication with the data processor. Further, the machine includes a computer memory which stores program instructions executable by the data processor to carry out operation of the entertainment machine. In one embodiment of operation, the entertainment machine may be programmed to present, on the user interface, graphical representations of a draw pile of cards, a discard pile of cards, and a dealt hand of a player on the user interface. The system may then deal the dealt hand to the player, the dealt hand comprising graphical representations of a random selection of a portion of a deck of cards, the deck of cards consisting of 72 total cards comprising five color groups with each color group having nine numbered cards and four action cards, and further comprising seven non-colored cards, the non-colored cards comprising a match card and a reverse/reveal card. The game is then set up to play via the user interface. The system is then operable to receive a discard input of a card of the dealt hand, the card matching one of a color, number, or text of a top card in the discard pile. The system may also receive a draw request if there is no card in the dealt hand which matches the one of the color, number, or text of the top card in the discard pile, the draw request adding a randomly selected card to the dealt hand from a quantity of cards remaining in the deck of cards. When a player wants to use a reverse/reveal card which is in their dealt hand, receiving a discard input of the reverse/reveal card, wherein the reverse/reveal card causes the user interface to display a pop up window within the user interface, the pop up window comprising a first actuation area indicating a reverse option which, up actuation through the user interface, reverses a direction of play of a plurality of players in the game, including the player, the pop up window further comprising a second actuation area indicating a reveal option which, upon actuation through the user interface, allows the player to select one of the plurality of players in the game and causes the selected one of the plurality of players to reveal a card in a dealt hand of the selected one of the plurality of players. The steps of receiving the discard input and receiving the draw request until at least one of the plurality of players has no cards remaining in the dealt hand.

In certain aspects, a computerized device such as smart phone or tablet carrying out the entertainment system may comprise a motorized actuator to provide haptics feedback upon certain inputs in to the user interface. These haptic feedbacks corresponding to certain steps or actions performed on the user interface by the user and/or by game play performed by other players and received through a networked connection to the computerized device provide a more tactile, engaging, and overall "real" experience compared to traditional computerized card gaming and improves the real-life feel of the system, a known problem in the art of computerized interfaces.

DETAILED DESCRIPTION

Figure 1:
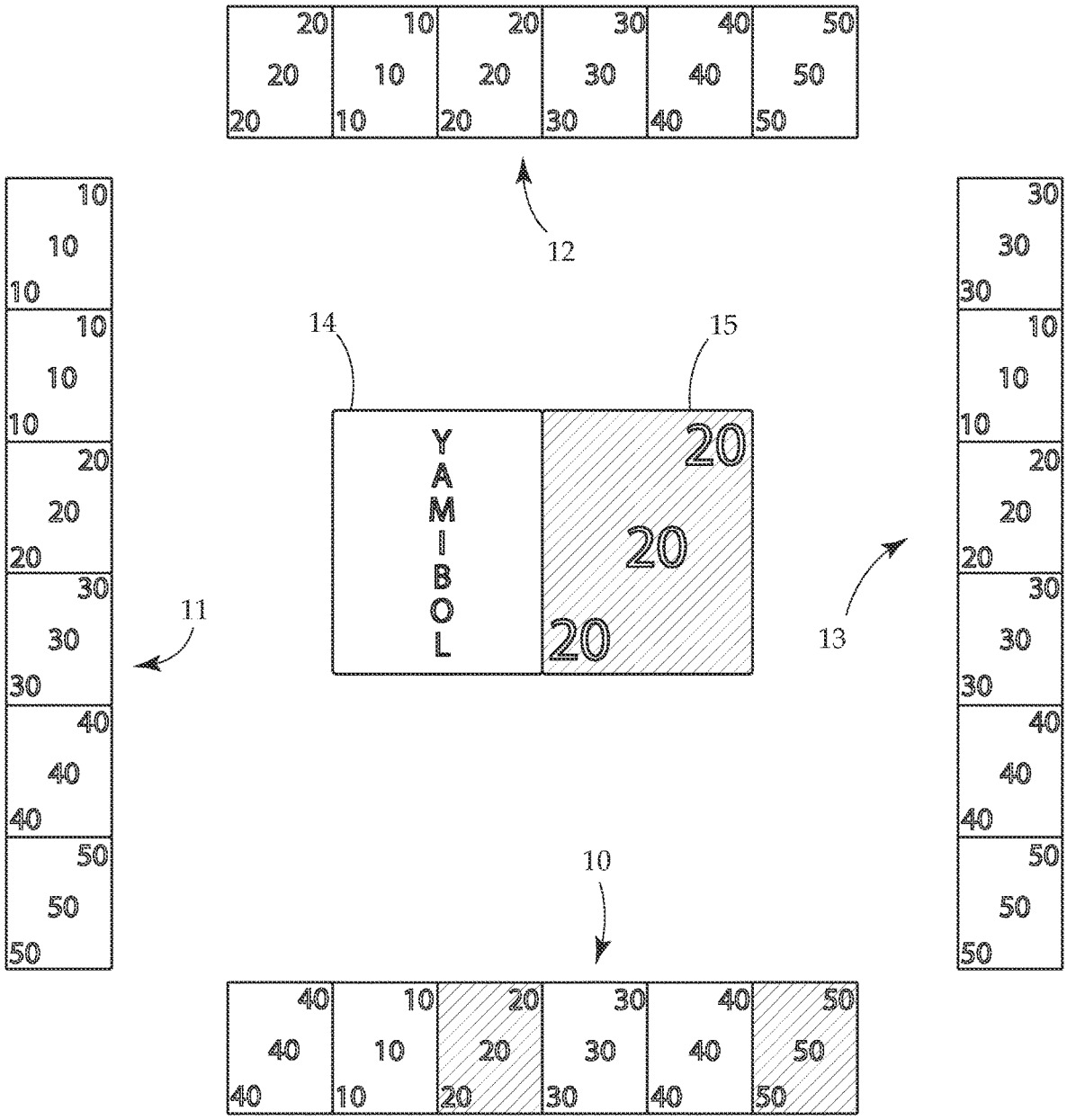
FIG. 1 provides a view of an embodiment of an game play layout of the present disclosure.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, an entertainment system, also referred to as an entertainment machine providing a unique operation, payout, programming, and structure is provided herein. The entertainment system provides an exciting, entertaining, and engaging new system. The entertainment machine provides optional, unique game play features. These features may include a unique game play and set of cards (physical or virtual) which focuses on strategic play and player engagement.

The present disclosure relates to an entirely new card game to the industry, which gets away from the usual paradigm of many new games (which are just a slight tweak to an already established game). This game is unlike any other game in the industry, and will provide more nuance and variety to an industry that is constantly trying to retain the attention of its current consumers, as well as grab the attention of potential consumers.

The gaming system may be carried out using physical cards in one embodiment. In another embodiment, the gaming system is operable on a computerized system which carries out the steps of the card game entertainment system, as well as receives input through a user interface to allow a player to play the game. In computerized embodiments, in many cases, other players may join a networked game and can play with other players using their own computerized device in communication with the other computerized devices of other players in the game.

Initially, the system will begin by setting up the game, either by manually dealing and placing cards, or by the computer determining the card order and presenting the cards on the screen.

In one embodiment, a deck of cards comprising 72 cards. This deck comprises five different color sets, with each color set comprising nine numbered cards, and four action cards. In one embodiment, the numbered cards count up by 10 starting at 10 and ending at 90. In another embodiment, the four action cards may include a "draw" card which allows the player to take a top card from the draw pile, a "take" card which allows the player to take a random card from a player, a skip card which skips the next player in the game's order, and a repeat turn card which allows the player to repeat his or her turn. The action of the card is triggered by the player placing the card on the discard pile. Of course, other numbered cards and numbers of different colors may be used without straying from the scope of this invention.

In addition to the colored cards, there may be "off-white" i.e. non-colored cards. One non-colored card is a "Match" card which, upon playing the card, allows the player to pick a color which must be played next. Another non-colored card is a "Reveal/Reverse" card. This card may allow a player who plays it to either require another player to reveal one of their cards, or may allow the player who plays it to reverse direction of game play. In one embodiment, there may be seven non-colored cards.

In a particular embodiment, the deck of cards may further comprise a "Steal the Bonus" card, which gives the player who randomly chooses it 2 additional points along with the points this player has already won from the round. A drawing process should be executed after each round from a deck with random cards plus the "Steal the bonus" card. The total number of the cards, including this new card should be equal to the number of the players.

In a further embodiment, a "blank" card may be included in the deck. The blank card may allow players to assign whatever function they want to the card, providing an additional enhancement and intrigue in the game play.

Gameplay operation on the computerized gaming machine, or table game, will involve a dealing and setup, and then game play. The goal of the game is to get rid of all cards in a hand. Game set up involves a shuffling of the cards and dealing to all players (either physically or virtually). Cards are then dealt to players. In one embodiment, players may get 8 cards in their hand. In another embodiment, players may get 6 cards in their hand. Remaining cards are placed face-down as a draw pile. One card from the draw pile is flipped over to begin the discard pile.

Game play begins with picking a player to go first. On each player's turn, the player must take one of two actions: Play a card from the player's hand onto the discard pile, or draw a card to add to the player's hand. To play a card onto the discard pile, the player must play a card which has a matching number as a card on top of the discard pile, a matching color as the card on top of the discard pile, or matching text as the card on the top of the discard pile. If this cannot be done, and an action card may not be played, then the player must draw a card from the draw pile and add it to the player's hand. Play continues in this manner until a player runs out of cards, at which point that player will be declared a winner.

In one example of game play, let's say we have 4 players in the following order—Olivia, Jayden, Sophia and Mike. Olivia plays "30 blue". Next it's Jayden's turn. He has to match the number 30 with the same number from different color or to play any of the 13 cards from the blue color. If he can't do the match, he must take the top card from the draw pile. This is the common rule, but Jayden might have another option. If he has in his hand off white "Match" or "Reveal/Reverse" card, he can play it now. These cards have the ability to match any color. They can be played every time, when a player has a turn and the previous card doesn't prompt him/her to perform specific action (to take a card from the draw pile or another player, or to lose his/her turn, because he/she is being skipped). Functions of these 2 cards:

The "Match" card operates such that once such card is played, the player who discarded it has to say immediately what would be the required color for the next player to match. For example: Jayden plays "Match" card and says the next color would be "Orange". Sophia's only option to match is the orange color (not number or text).

The "Reveal/Reverse" card gives the player, who discards it 2 great alternative opportunities: First, the player may prompt the next player to reveal to everyone one of his cards and by doing that, to lose his/her turn. Or the player may elect to reverse the direction of the game play from right to left or from left to right.

In our case if Sophia plays "Reveal/Reverse" card and chooses "Reverse" option, it would be Jayden's turn to play, instead of Mike and the game goes counter clockwise. When this card is played, it should be placed on the top of the discard pile in a way, so everyone can see the previous card. This is important, because after this action is completed, the players have to match the previous card (either by color or number/exact text).

There are also other colored action cards. These include:

A repeat or "Oops! My turn again" card. If Mike plays this card, it is his turn again and he must play another card. If he can't do the match by color or exact text and he doesn't have off white card, he must take the top card from the draw pile.

"Skip a player"—If Olivia plays it, Jayden is being skipped and it is a Sophia's turn. Jayden doesn't have any defense against this card.

"Take the top card from the draw pile"—If Sophia plays it, the next player, Mike, has to take the card from the draw pile and to lose his turn. But instead of doing that he can counter attack with another card with the same exact text, but from different color (if he has one). Next it would be Olivia's turn and she must take 2 cards (1 for Sophia's attack and 1 for Mike's attack). Of course, she can counter as well, if she has the same card.

"Take a random card from a player"—this could be any player. Similarly to the previous card, this one can be countered as well. If the other player has only one last card, that is being taken, he/she is the winner. For example: Olivia plays this card, but Jayden counter attack. Now Sophia must take 2 cards from the other players (could be from the same player or different players).

In various embodiments, the following rules may be applied. If there are no more cards left in the draw pile, the players use the top card from the discard pile to start a new one. All of the other cards are placed face down to create a draw pile again.

Even if a player has a matching card, he/she is not obligated to play it. That player can simply choose to take another card from the draw pile, if this is in his/her best interest.

Once a player discard the last card in the hand, the game is over for him/her. This is true even if the last card says "Oops! My turn again".

After the winner is determined, the game may continue with the rest of the players, so when they finished, everyone gets points, depending on the order in which he/she finished. For example: if they are 9 players, the winner gets 9 points, the second-8 points and so on. If they are 3 players, the winner gets 3 points and the last one gets 1 point. Depending on the number of the players, they set up in advance a goal/score to reach. The game is over, when someone reaches it. For example if they are 9 players—they can agree on 25 points. If they are 2 players, the goal should be 8 or 10 points.

In another embodiment, the same deck of cards may be used to play another card comparison game called "battle of the numbers." This further provides engaging and advantageous game play to the players. This game may be played using the physical deck of cards or in a computerized embodiment. The game may be played as a side game mixed in with a series of games of the above-mentioned card matching game, or on its own. This game develops the child's ability to read and compare the value of two numbers, but it is fun and entertaining for people of all ages. The object of this embodiment of game play is to collect all the cards from the other players.

Game set up involves removing any of the colored action cards such that only the non-colored cards and numbered cards remain. All of these cards and an equal number is dealt to each player. For example, in one embodiment, the number of dealt cards may be as follows: For 2 players—26 each; For 3 players—17 each; For 4 players—13 each; For 5 players—10 each, and so on. The rest of the cards are put to the side and are not involved in the game.

Each player has a pile of cards facing down in front of them. To 'battle', each player turns over the top card of their pile. The player with the highest value keeps the 2, 3, 4 or 5 cards. If they are 2 or more highest matching cards, the players who played them have to continue the battle by turning over the next card in their pile until one player has the highest numbered card. Ultimately only 1 player collects all the cards from the floor. When a player flips over a non-colored card, the following game play options apply:

Function of the off white cards with warriors: For the "Match" card, the function is to match the winning card from the other players, so there would be a "battle" where the player and the other highest card player draw cards until one player has the highest numbered card. The "Reveal/Reverse" cards also match the winning cards, but also reverse the rule for who wins the hand. If the highest card was the winner, from now on, the winner would be the lowest. This continues until another "Rev/Rev" card is played. If the two "Rev/Rev" cards are played at the same time, they reject each other and do not reverse the direction. The players who do not have any more cards in their possession are cut off and the game continues with the rest of the players.

Example: Let's say we have 3 players—William, Emma, and Natalie. William plays "50", Emma "30" and Natalie plays off white "Match" card. In this case Emma is cut off and the other players continue the battle. So, William and Natalie both have "80" this time. The battle continues. On the 3rd play William wins with "60" against Natalie's "50" card.

Another example: William plays "20", Emma "Match" card and Natalie "Reverse" card. The battle continues between all of them and from now on the lowest card would be the winner. On the next play William plays his last card in hand—"40". Emma plays "40" as well, and Natalie "80". In this case Emma takes all the cards from the floor, because William can't continue and she has the lowest card. For the next round the lowest card would be the winner.

This game lacks any strategic thinking, but with so many chances for battle it is very entertaining and the time is flying by. In many cases though, it takes a lot of time for someone to collect all the cards. So, it is a good idea to setup alarm clock for 10 or 15 minutes. Whoever has the most cards, when the time expire, would be the winner. If two players are tide, they can agree on 1 minute overtime.

The game ends either when one player collects all the cards or the time expires.

In one embodiment having a computerized entertainment system including, but not limited to a computerized game system or machine, program instructions to randomly deal game visual representations of game cards are stored on a memory. In addition, a checking algorithm is stored on the memory which may be used to check and re-check the actual randomness of the dealing to ensure that certain players are not advantaged by receiving a higher or lower amount of certain cards that would statistically be expected over time. It is a known problem in the computer arts that the programming of a pure randomizer may "drift" over time away from the desired weighing. Therefore, this algorithm operates as a check or "self-diagnostic" to compare the dealt cards to an expected random disturbing of the cards, to ensure that the weighting does not stray from the desired random distribution of cards. The diagnostic algorithm may check randomness of the dealt cards periodically, such as hourly, every 12 hours, daily, every two days, weekly, monthly, or the like. If the distribution is off by a certain amount, the processor may make adjustments to the dealt cards in the future to return the distribution of dealt cards to the expected random distribution.

In a computerized embodiment, a computer may provide one or more computerized "players." Such a computerized player may be programmed to carry out gameplay in a competent fashion. Computerized players solve the problem of non-networked computer game play in the event that either a player wants to play but cannot gather enough other players, or wants to play but does not have networked access to reach other players online.

In electronic versions of the present invention, a computer having a computerized data processor controls the game play of the machine. The randomizer may be a programmed module, such as an instruction set executable by a data processor, stored in a memory. The computer may be further configured to receive inputs from the interface, and provide output through at least a display screen and, optionally, through other outputs such as a haptics actuator such as a motorized actuator, lights and/or speakers. In one embodiment, the display may be a touch screen, such that it also may receive inputs such as those noted above. Such electronic versions of the present invention may include a computerized entertainment machine, and may also be in the form of fully digital implementations such as a computerized implementation playable on a computer such as a tablet, smartphone, kiosk, desktop or laptop computer, as well as network based embodiments, internet embodiments, or application embodiments.

In further detail, an embodiment of entertainment machine contemplated herein may comprise a data processor. The processor may be in communication with a display, a player interface, as described herein, and a memory. The memory may contain instructions for the processor to carry out the randomizer module, as well as electronic representations of the cards or markers, game layout, and related graphics, for presentation by the display. The memory may further contain program instructions, in addition to the randomizer module's instructions. These instructions are executable by the data processor to conduct the steps of the game play, as will be detailed below.

One aspect of the invention may also include a non-transitory computer readable medium having instructions allowing and instructing the data processor to carry out the steps required during game play of the entertainment machine, as described herein. This non-transitory computer readable medium may be stored within the housing of the entertainment machine, or may be accessible through an electronic communication system such as a network and/or internet connection.

In certain machine based embodiments, a networked operation to allow multiple players on different machines to engage in the same game. This may provide an enhanced social aspect to the entertainment machine and system. In such embodiments, a computerized network connection connects the memory and processor of the entertainment machine to the internet, local area network, and/or other entertainment machines directly. The networked connection may provide an input to a particular entertainment machine, and this input may cause the processor to display a hand of a networked user playing on that different computerized entertainment system on the display of the entertainment system.

In computerized embodiments of the entertainment system, a common issue faced by players is that the "feel" of a computerized game is lacking. For example, players report missing the feeling of tangible cards and the enjoyable tactile sensations involved with holding, manipulating, and playing the cards. The traditional screen only user interface for computerized card gaming causes this. In some embodiments, the present invention solves this lack of enjoyable game play by employing haptics on equipped devices such as smart-phones, tablet computers, and the like. In such embodiments, touch gestures may be made into a touch screen which mimics the feel of playing, drawing, and moving actual cards. In addition to the tough gestures, haptics such as a shake or vibration occur when a user selects a card, places a card, draws a card, discards a card, and the like to provide a more engaging tactile feedback to the player. In many embodiments, the haptics effects are achieved by a small motorized actuator which moves or spins to cause the feeling of a shake, tap, vibration, and other tactile sensations. In a particular embodiment, the motorized actuator is a linear actuator within the computerized device body which is carrying out the entertainment system. Such computerized devices may include but are not limited to smartphones, tablets, and the like, but of course any computerized device may be equipped with such a haptics actuator. This swiping and haptic feedback better engages the user and solves the problem of an un-engaging, and abstract computerized card game play experienced in the prior art. Specific examples of swipe motions may include, but are not limited to a swiping from side to side or up and down to move a card from a player hand to the discard pile, and/or drawing a card from the draw pile to the player hand. Haptics may involve taps, shakes, and the like on the device itself and/or on a paired wearable computing device such as a smart watch or headset. This input may be actuated when a card is in the middle of being played, to remind a player of their turn or otherwise notify the player, when setting a card in the discard pile, when drawing a new card, and when moving the card to the user's hand, among other options.

Turning now to FIG. 1, a view of an embodiment of game play is provided. This embodiment has four players, each with a dealt hand shown as elements 10, 11, 12, and 13. The player's own hand 10 is visible to him or her, but the other player hands, 11, 12, and 13 are not. There is a draw pile 14, and discard pile 15. This game play set up is then usable to carry out the steps of the game.

Figure 2:
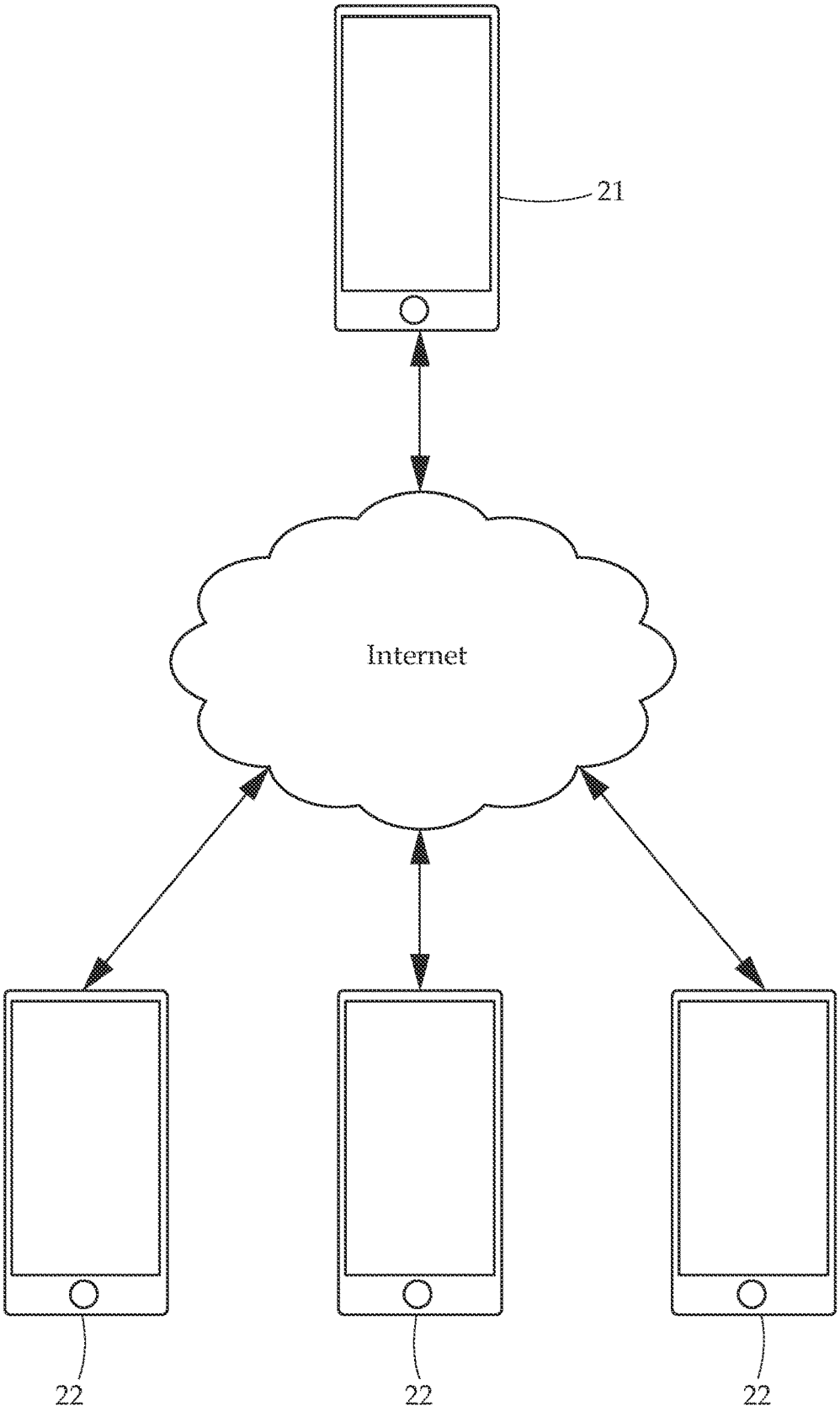
FIG. 2 provides a networked schematic of an embodiment of the entertainment system being played on computerized devices over a network.

FIG. 2 provides a view of a networked interface of a first player computer 21, shown here as a smart phone, in networked communication for game play with a plurality of other user computers 22 through the internet. Information can travel via the network between the first player computer 21 and other user computers 22 to allow for game play inputs and results to be shared among all players.

Figure 3:
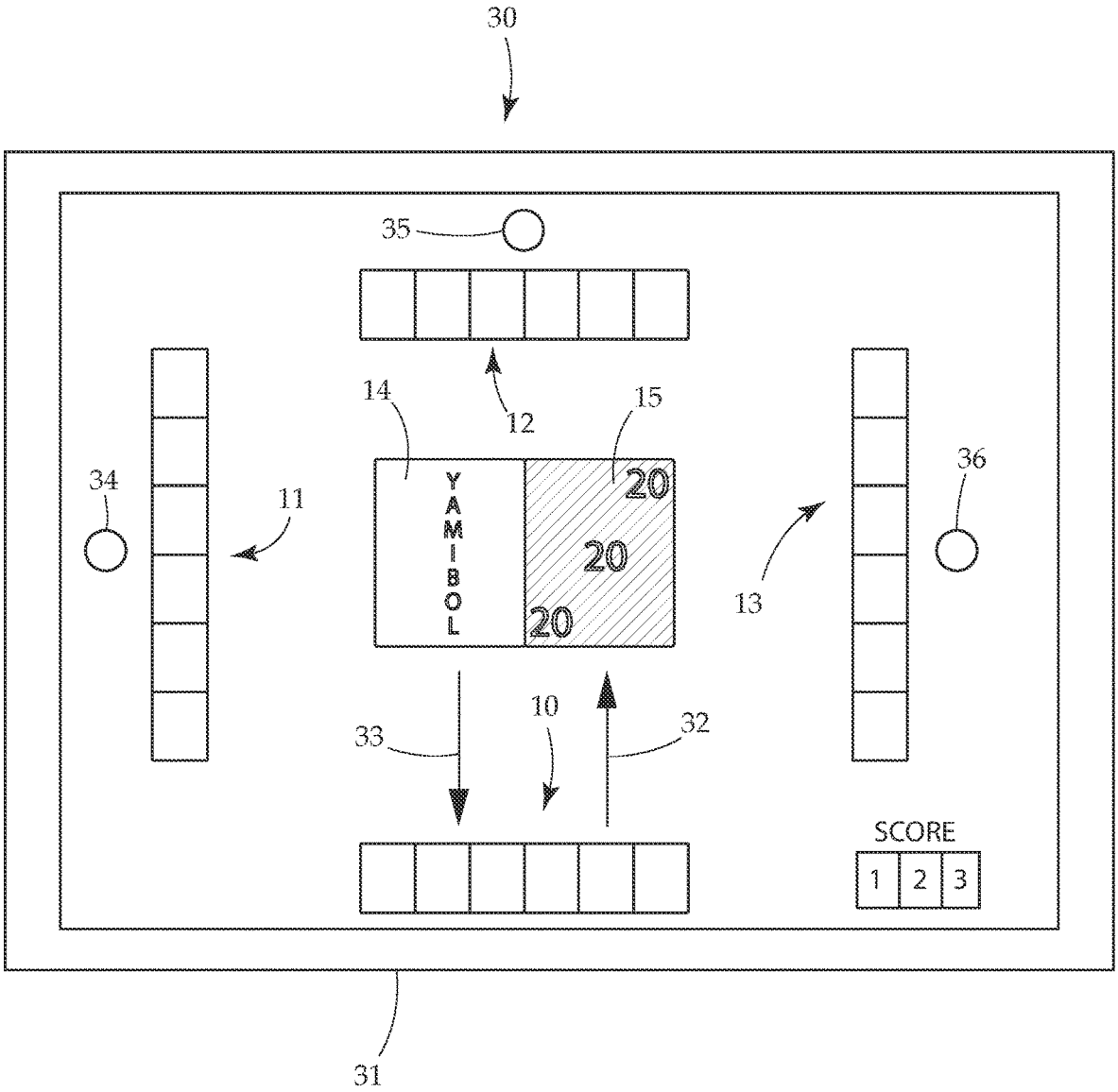
FIG. 3 provides a view of an embodiment of the entertainment system of the present disclosure being played in an entertainment machine.

FIG. 3 provides, a view of an embodiment of entertainment system implemented on a computerized entertainment machine. The entertainment machine has a body 30 which houses internal components, and a display 31, shown here as a touch screen, which provides the user interface for the entertainment system. This embodiment has four players, each with a dealt hand shown as elements 10, 11, 12, and 13. Players are represented in the computerized display as icons at 34, 35, and 36. The player's own hand 10 is visible to him or her, but the other player hands, 11, 12, and 13 are not. There is a draw pile 14, and discard pile 15. This game play set up is then usable to carry out the steps of the game. Arrows 32 and 33 represent a swiping motion that causes a user to move a card in his hand to the discard pile (arrow 32) and a swiping motion that causes a user to move a card from the draw pile to the player's dealt hand 10. In many embodiments, the swipe motion will be coupled with a haptics output to add to the realistic feel and tactile experience of the game, as discussed above.

Figure 4:
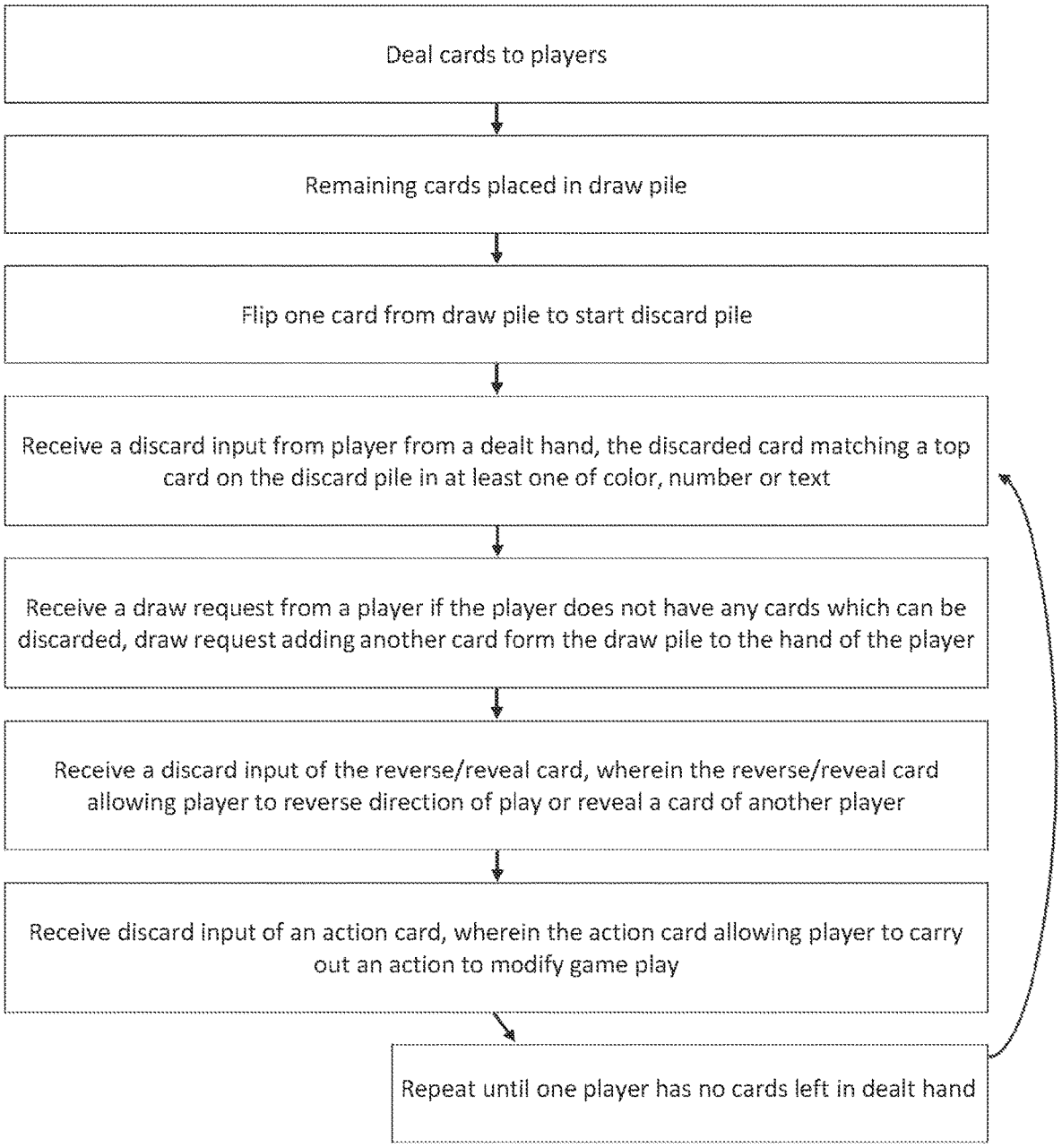
FIG. 4 provides a flow chart of an embodiment of the entertainment system.
Figure 5:
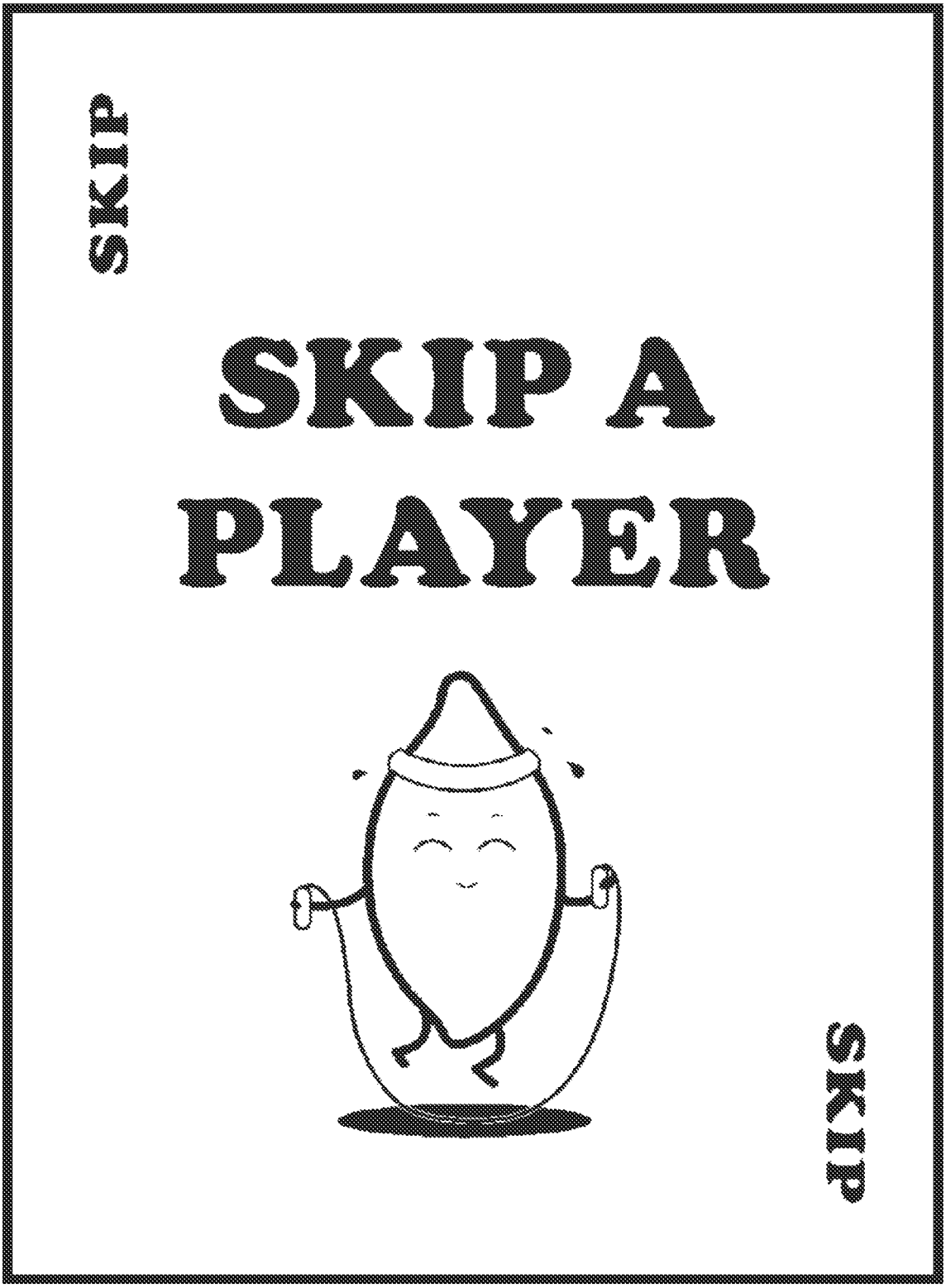
FIG. 5 provides a view of an action card of the present entertainment system.
Figure 6:
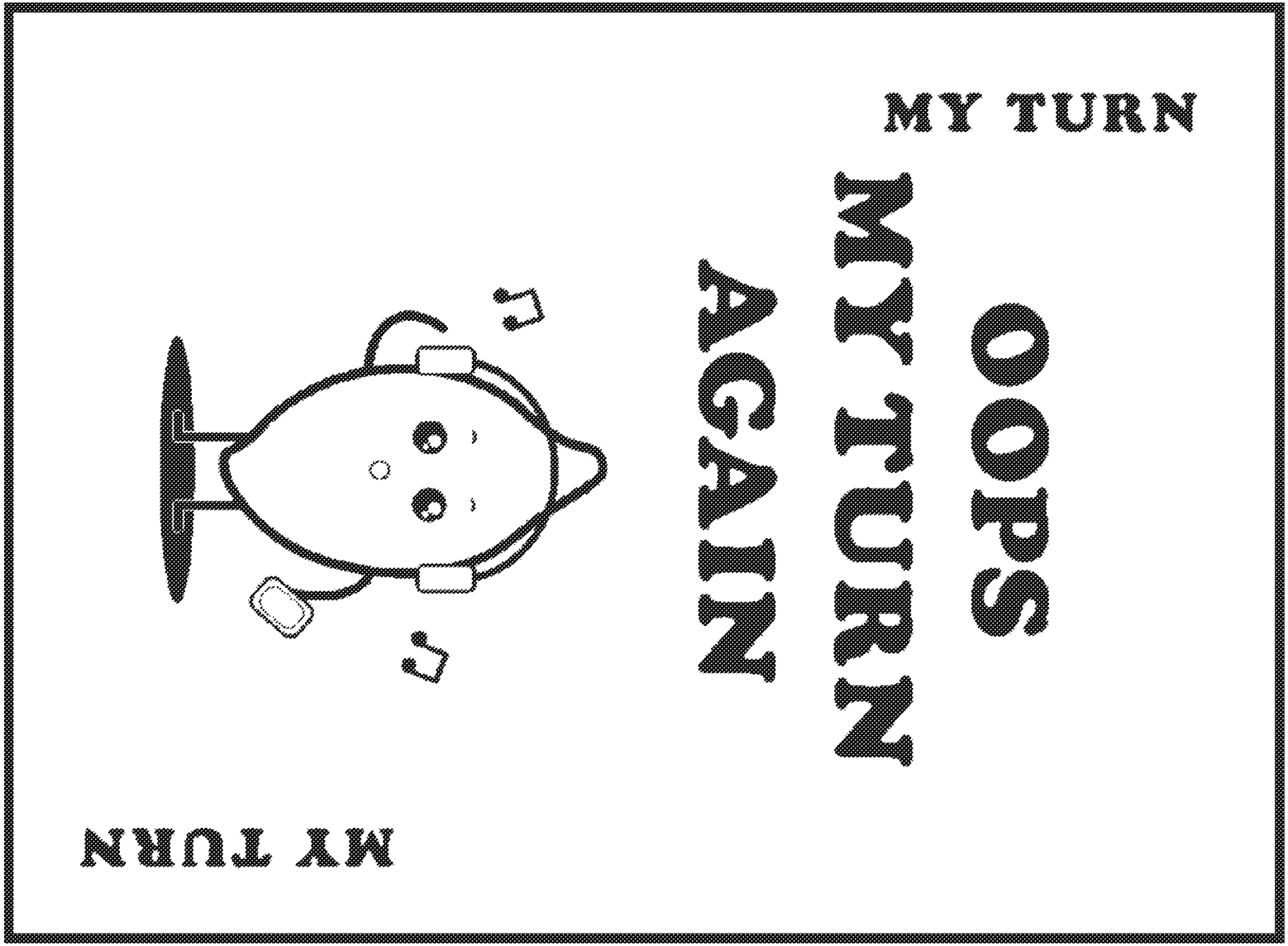
FIG. 6 provides a view of an action card of the present entertainment system.
Figure 7:
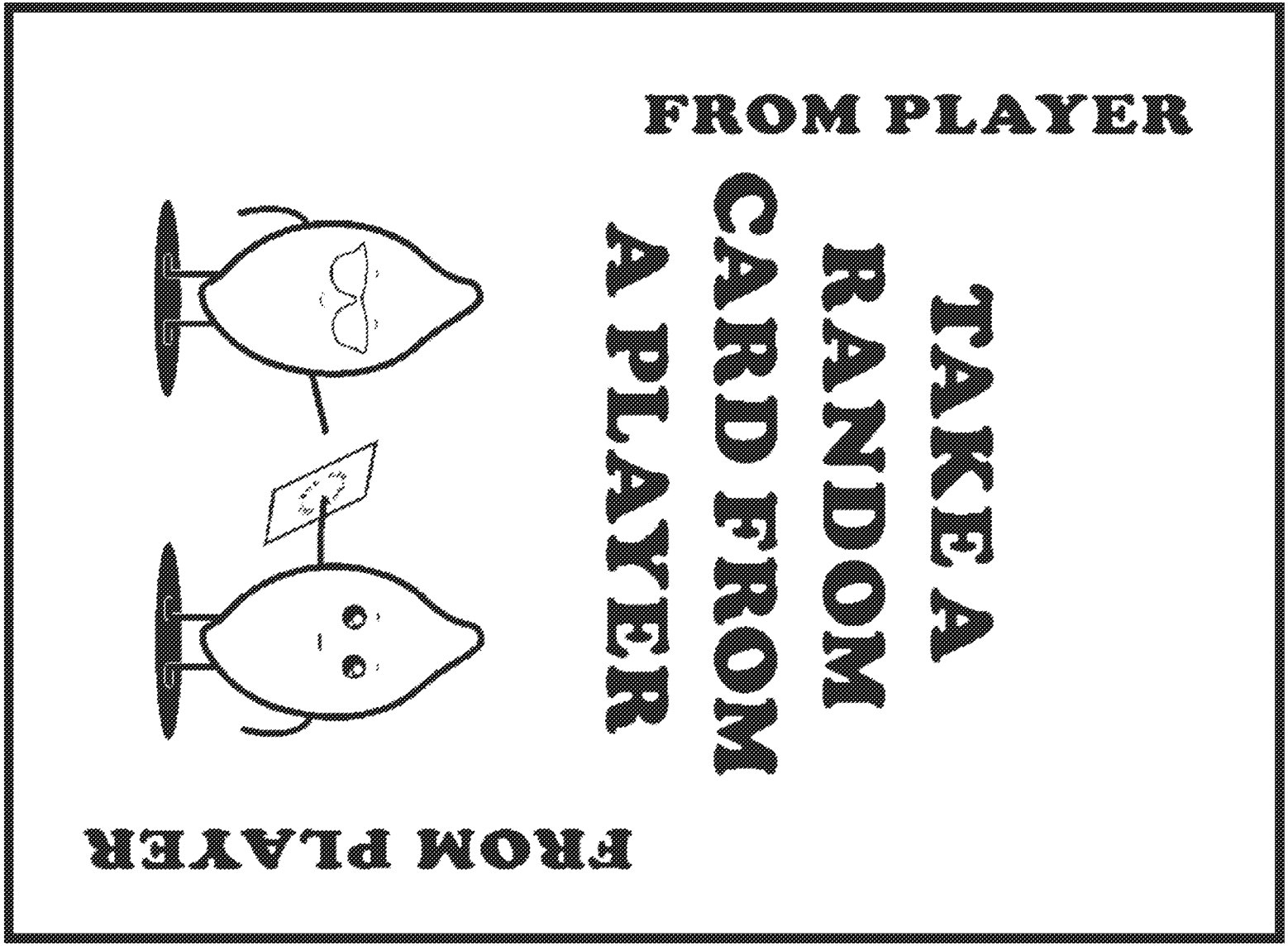
FIG. 7 provides a view of an action card of the present entertainment system.
Figure 8:
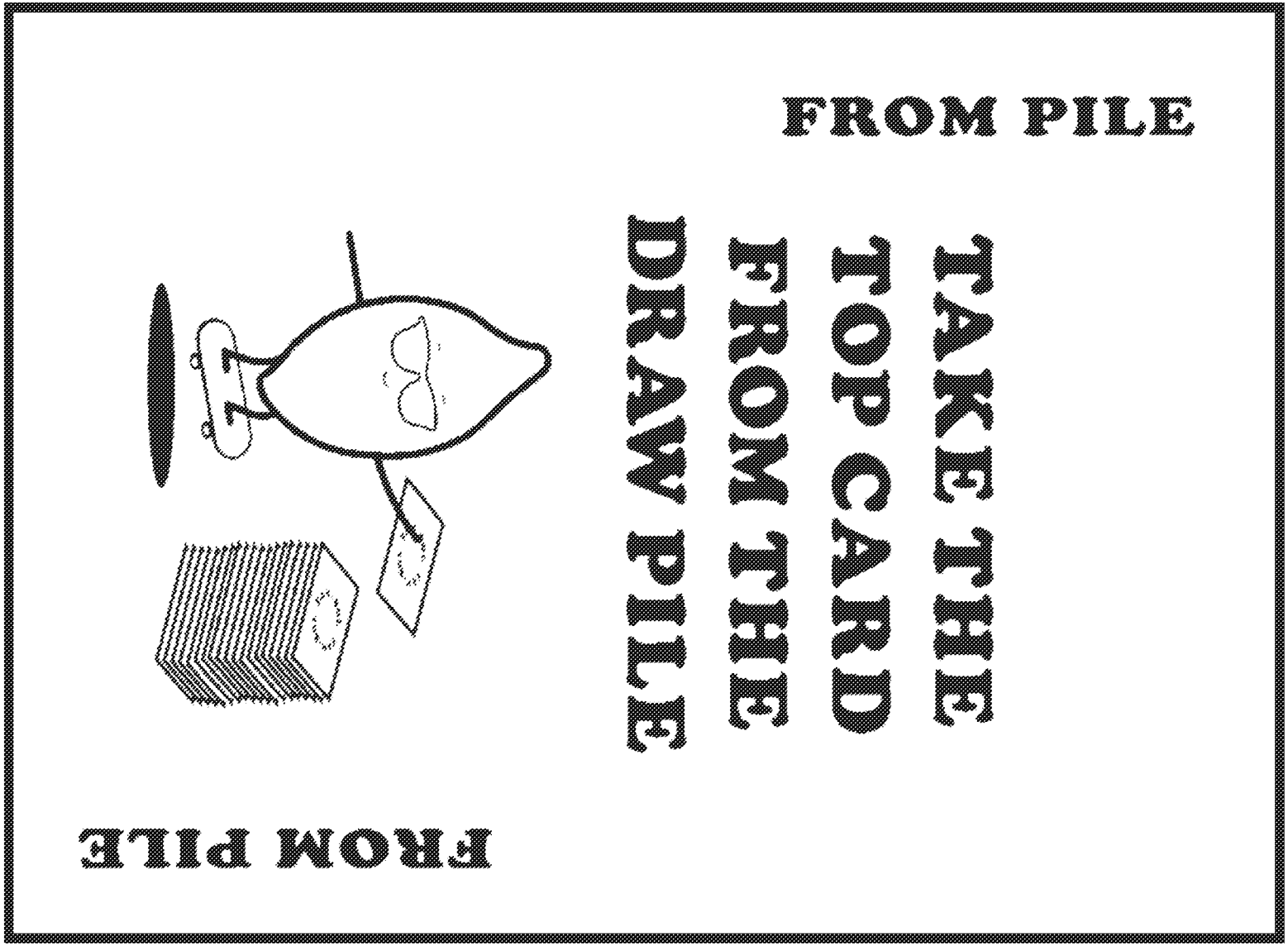
FIG. 8 provides a view of an action card of the present entertainment system.
Figure 9:
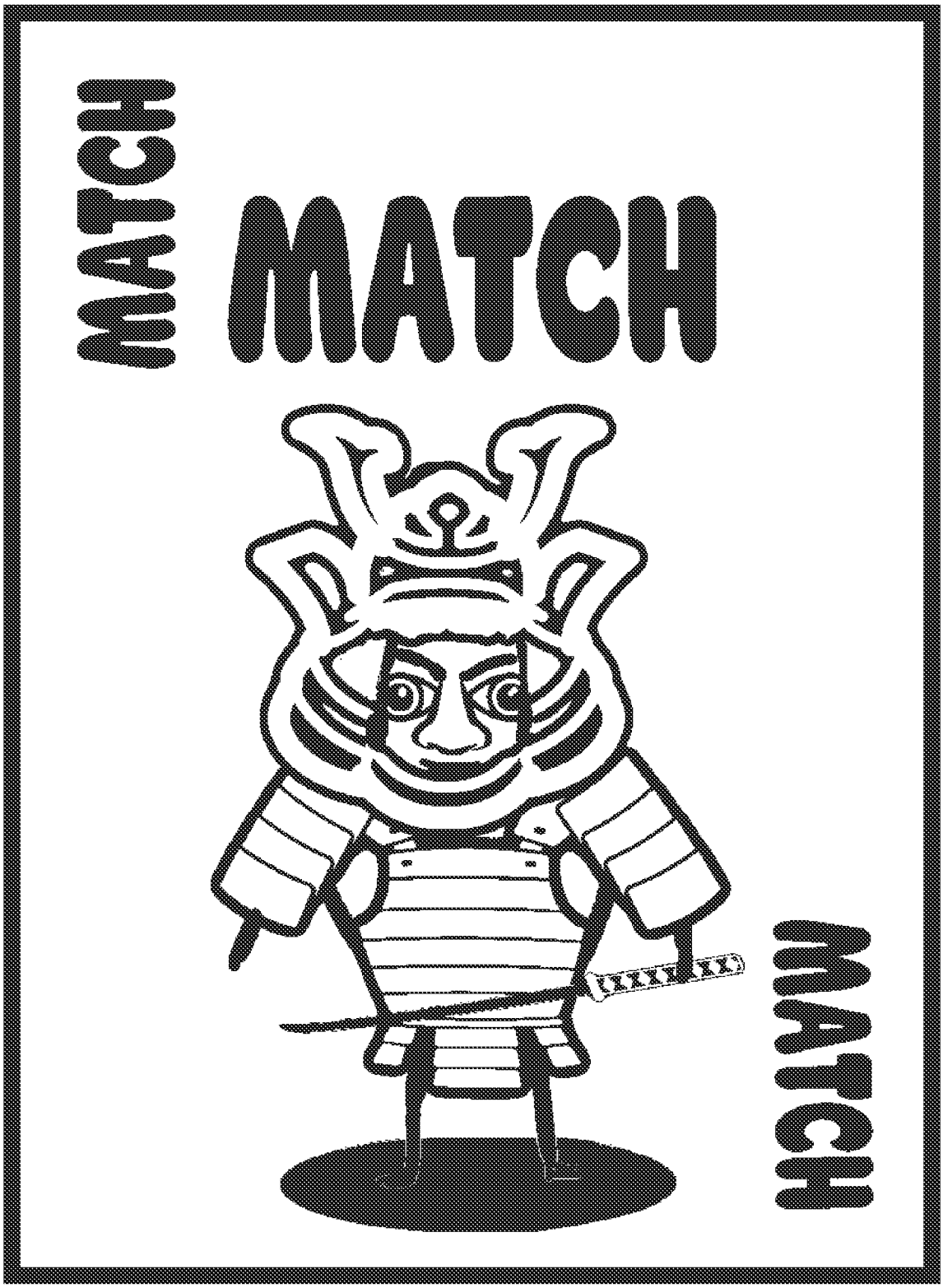
FIG. 9 provides a view of an action card of the present entertainment system.
Figure 10:
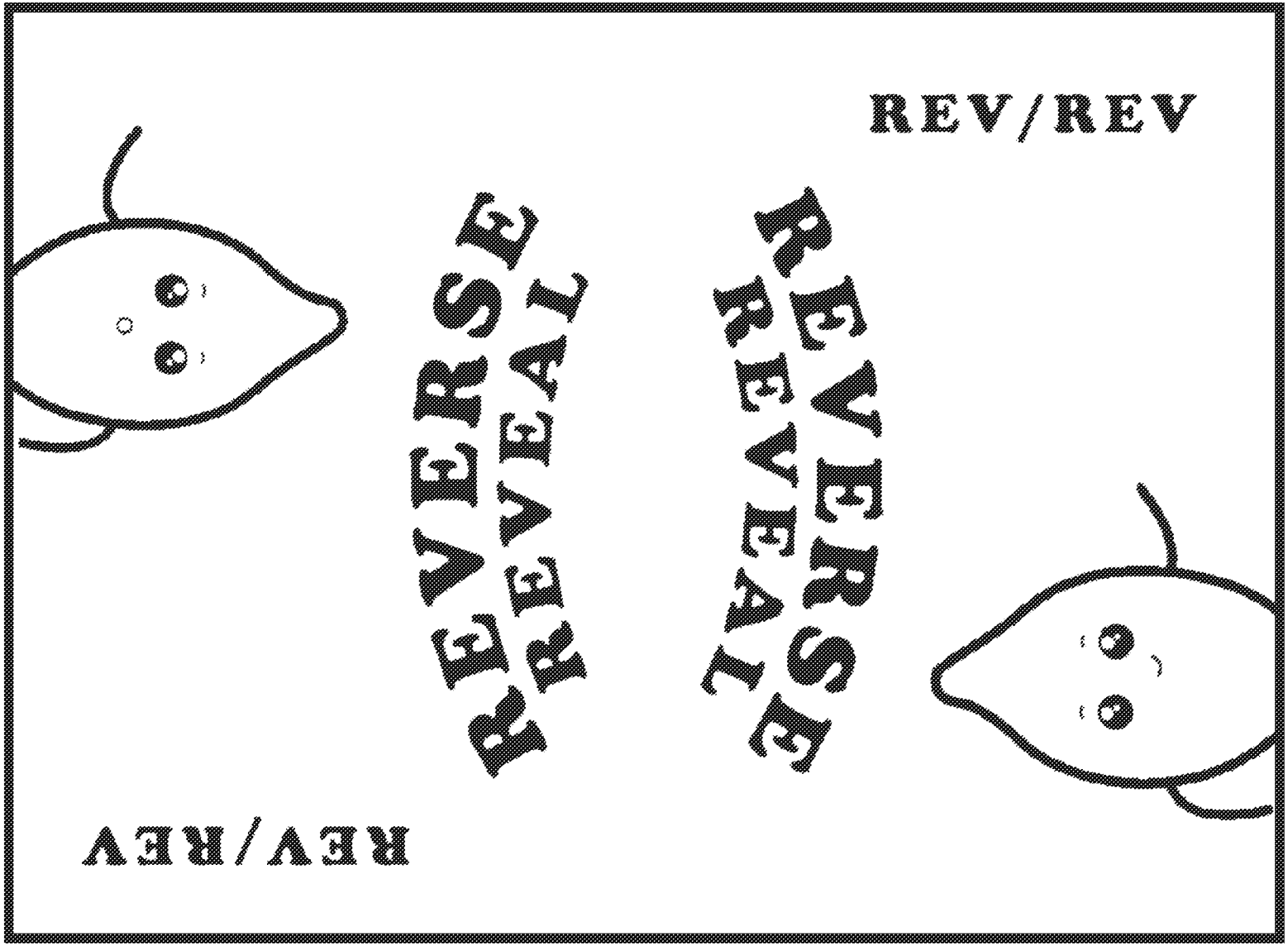
FIG. 10 provides a view of an action card of the present entertainment system.

FIG. 4 provides a flow chart of an embodiment of game play of the present invention. The process begins with dealing cards to each player. The remaining cards of the deck of cards is placed face down in a draw pile. One card is flipped over face up to start a discard pile. The embodiment described in this flow chart if for a computerized embodiment, but of course the same implementation may be performed in a physical card deck embodiment. The system receives a discard input from player from a dealt hand, the discarded card matching a top card on the discard pile in at least one of color, number, or text. This reduces the number of cards in the hand of the player. If the player cannot discard, the system receives a draw request from a player if the player does not have any cards which can be discarded, draw request adding another card form the draw pile to the hand of the player. Each of these steps would end a player's turn and the next player then plays, making a similar decision to discard or draw. In certain cases, if a player has the card in their hand, the system may receive a discard input of the reverse/reveal card, wherein the reverse/reveal card allowing player to reverse direction of play or reveal a card of another player. In similar cases, if the player has another action card in their hand, they may play it, such that the system may receive a discard input of an action card, wherein the action card allowing player to carry out an action to modify game play according to the instructions of the action card.

FIGS. 5-10 provide views of various embodiments of action cards usable in the entertainment system. Each card provides instructions for game play modification, as well as a charming character, shown in these embodiments as a yam.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. An entertainment machine for conducting an entertainment system comprising:

a data processor;

a display in communication with the data processor a user interface operable by the data processor; and a computer memory, wherein the computer memory is configured to store program instructions executable by the data processor to conduct the steps of:

presenting on the user interface graphical representations of a draw pile of cards, a discard pile of cards, and a dealt hand of a player on the user interface;

dealing the dealt hand to the player, the dealt hand comprising graphical representations of a random selection of a portion of a deck of cards, the deck of cards comprising 72 total cards comprising five color groups with each color group having nine numbered cards and four action cards, and further comprising seven non-colored cards, the non-colored cards comprising a match card and a reverse/reveal card;

receiving a discard input of a card of the dealt hand, the card matching one of a color, number, or text of a top card in the discard pile;

receiving a draw request if there is no card in the dealt hand which matches the one of the color, number, or text of the top card in the discard pile, the draw request adding a randomly selected card to the dealt hand from a quantity of cards remaining in the deck of cards;

receiving a discard input of the reverse/reveal card, wherein the reverse/reveal card causes the user interface to display a pop up window within the user interface, the pop up window comprising a first actuation area indicating a reverse option which, up actuation through the user interface, reverses a direction of play of a plurality of players in the game, including the player, the pop up window further comprising a second actuation area indicating a reveal option which, upon actuation through the user interface, allows the player to select one of the plurality of players in the game and causes the selected one of the plurality of players to reveal a card in a dealt hand of the selected one of the plurality of players; and repeating the steps of receiving the discard input and receiving the draw request until at least one of the plurality of players has no cards remaining in the dealt hand.

2. The entertainment machine of claim 1 wherein the plurality of players are in a networked connection with the data processor.

3. The entertainment machine of claim 1 wherein the plurality of players are in networked connection with the data processor via a plurality of user interfaces.

4. The entertainment machine of claim 1 wherein at least one of the plurality of players is a computerized player.

5. The entertainment machine of claim 1 wherein the step of receiving the discard input comprises receiving a swipe input to a touch screen in communication with the user interface, the swipe input corresponding to a position of the card in the dealt hand and the graphical representation of the discard pile.

6. The entertainment machine of claim 1 wherein the step of receiving the draw request comprises receiving a swipe input to a touch screen in communication with the user interface, the swipe input corresponding to a position of the graphical representation of the draw pile and the dealt hand.

7. The entertainment machine of claim 5 wherein the entertainment system further comprises a motorized actuator for haptic feedback to the player, and wherein the step of receiving the discard input causing the microprocessor to activate the motorized actuator to provide haptic feedback to the player by a movement of the actuator.

8. The entertainment machine of claim 7 wherein the haptic feedback is one of a vibration, a shake, a tap, and a plurality of taps.

9. The entertainment machine of claim 7 wherein the motorized actuator is positioned within one of a smart phone and a tablet.

10. The entertainment machine of claim 6 wherein the entertainment system further comprises a motorized actuator for haptic feedback to the player, and wherein the step of receiving the draw request causing the microprocessor to activate the motorized actuator to provide haptic feedback to the player by a movement of the actuator.

11. The entertainment machine of claim 10 wherein the haptic feedback is one of a vibration, a shake, a tap, and a plurality of taps.

12. The entertainment machine of claim 10 wherein the motorized actuator is positioned within one of a smart phone and a tablet.

13. The entertainment machine of claim 1 wherein the user interface is operable to display a graphical representations of a rear of cards of a dealt hand of the plurality of players, allowing the user interface to display a total number of cards in the dealt hand of each of the plurality of players.

14. The entertainment machine of claim 1 wherein the processor is further operable to perform a check on the random selection of the portion of the deck of cards dealt to the player, the check comprising comparing a quantity of cards dealt over a predetermined time period to an expected random distribution of cards of the deck.

15. The entertainment machine of claim 1 wherein the check on the random selection of the portion of the deck of cards dealt to the player further comprises an adjustment to the dealt cards to return the distribution of dealt cards to an expected random distribution.

16. The entertainment machine of claim 1 wherein the match card allows the player to change a color of a top card on the discard pile to match a card in the dealt hand.

17. The entertainment machine of claim 1 wherein the deck of cards further comprises a repeat turn card, wherein a receiving of an input to the processor through the user input allows a player to play the repeat turn card, in turn allowing the system to repeat one of the steps of receiving the discard input or receiving the draw request from the player.

18. The entertainment machine of claim 1 wherein the deck of cards further comprises a skip card, wherein a receiving of an input to the processor through the user input allows a player to play the skip card, in turn causing the system to skip one of the plurality of players.

19. The entertainment machine of claim 1 wherein the deck of cards further comprises a draw card, wherein a receiving of an input to the processor through the user input allows a player to play the draw card, in turn causing the system to automatically add a card from the draw pile to the dealt hand of one of the plurality of players.

20. The entertainment machine of claim 1 wherein the deck of cards further comprises a take player card, wherein a receiving of an input to the processor through the user input allows a player to play the take player turn card, in turn allowing the player to enter a player request into the user interface.

* * * * *